US005161733A

United States Patent [19]

Latif

[11] Patent Number: 5,161,733

[45] Date of Patent: Nov. 10, 1992

[54] HINGE LID CIGARETTE CARTON WITH INNERFRAME, AND BLANK AND METHOD THEREFOR

[75] Inventor: Linda S. Latif, Richmond, Va.

[73] Assignee: Philip Morris Incorporated, New York, N.Y.

[21] Appl. No.: 710,514

[22] Filed: Jun. 3, 1991

[51] Int. Cl.[5] ..... B65D 5/54

[52] U.S. Cl. ..... 229/225; 206/268; 206/273; 206/814; 220/416

[58] Field of Search ..... 229/225; 206/248, 268, 206/271, 273, 814; 220/416

[56] References Cited

U.S. PATENT DOCUMENTS

| | | | |
|---|---|---|---|
| 2,320,289 | 5/1943 | Marx | 206/624 |
| 2,367,476 | 1/1945 | Tyrseck | 206/268 |
| 2,396,150 | 3/1946 | Bonville | 229/44 |
| 2,473,055 | 6/1949 | Guyer | 229/37 |
| 2,771,988 | 11/1956 | Sweeney | 206/815 |
| 2,803,394 | 8/1957 | Ringler | 206/268 |
| 2,865,498 | 12/1958 | Ringler | 206/268 |
| 2,922,564 | 1/1960 | Van Rosen | 206/268 |
| 2,950,043 | 8/1960 | Ringler | 229/44 |
| 2,951,627 | 9/1960 | Wenzel | 206/624 |
| 2,992,766 | 7/1961 | Guyer | 229/44 |
| 3,037,683 | 6/1962 | Sherrill | 229/44 |
| 3,079,064 | 2/1963 | Ringler | 229/44 |
| 3,081,867 | 3/1963 | Corey | 206/248 |
| 3,708,108 | 1/1973 | Rosenburg, Jr. | 206/268 |
| 3,749,234 | 7/1973 | Gero | 206/273 |
| 3,794,238 | 2/1974 | Egli | 229/44 CB |
| 3,968,874 | 7/1976 | Corey | 206/248 |
| 4,072,263 | 2/1978 | Focke | 229/37 R |
| 4,180,201 | 12/1979 | Focke | 229/37 R |
| 4,200,221 | 4/1980 | Focke et al. | 449/44 CB |
| 4,241,827 | 12/1980 | Focke | 206/248 |
| 4,912,910 | 4/1990 | Lowe et al. | 206/814 |

FOREIGN PATENT DOCUMENTS

| | | | |
|---|---|---|---|
| 1068191 | 5/1967 | United Kingdom | 206/624 |
| 2229996 | 10/1990 | United Kingdom | 229/160.1 |

OTHER PUBLICATIONS

Drawing of a European ten-pack carton blank.
Drawing of a European five-pack carton blank.

*Primary Examiner*—Gary E. Elkins
*Attorney, Agent, or Firm*—Robert R. Jackson; Karen G. Horowitz

[57] ABSTRACT

A carton for holding several cigarette packs is made so that it generally resembles and functions like a conventional hinge lid cigarette pack. The carton is made from an integral blank including innerframe panels and outer member panels, all arranged in a single side by side series. When the blank is folded to make the carton, the innerframe panels are positioned inside the appropriate outer member panels. The blank also includes top and bottom tuck flap panels which can be closed in order to close the carton after the innerframe panels have been folded inside the outer member panels as described above. A particularly preferred method of making up the carton is shown. The consumer opens the carton by pivoting an upper portion of the outer member up and to the rear just as with a conventional hinge lid cigarette box. The innerframe interferes somewhat with this lid motion, thereby helping to keep the lid closed as in a conventional hinge lid cigarette box.

28 Claims, 8 Drawing Sheets

HINGE LID CIGARETTE CARTON WITH INNERFRAME, AND BLANK AND METHOD THEREFOR

BACKGROUND OF THE INVENTION

This invention relates to cigarette pack cartons which resemble and function like hinge lid cigarette boxes.

Hinge lid cigarette boxes are extremely well known and very popular. Such boxes include an outer member which has a lower main portion and an upper lid portion which is hinged to the rear of the lower main portion. When the lid is closed, the front, side, and rear walls of the lid act as vertical extensions of the corresponding walls of the lower main portion. The lid can be pivoted up and to the rear to open the box and allow access to the upper ends of the cigarettes standing in the lower main portion. An innerframe is provided inside the front and sides of the lower main portion so that it projects up above the lower main portion. This innerframe reinforces the front and sides of the box, and also provides some interference with the lid when the lid is pivoted open. This interference helps to keep the lid neatly closed and prevents the box from opening accidentally.

Hinge lid cigarette boxes are so popular and perform so well that it is thought to be desirable to provide cartons for holding several cigarette packs which are constructed and operate on similar principles. One such carton is shown in commonly assigned application Ser. No. 07/594,325, filed Oct. 9, 1990. The carton shown in that application works well and has many desirable features. However, there is always room for further improvement and for the provision of other features. For example, it would be desirable to provide a carton which uses less cardboard stock and which is better suited for set up empty and later filling with cigarette packs. In particular, subsequent manual filling may be desired under some circumstances, and it would be desirable to have a carton which is better adapted for such manual filling. As another example, it would be desirable to have the visible surface of the innerframe in the finished carton be the same surface of the blank as provides the outer surface of the finished carton. This would improve the appearance of the innerframe, and would also facilitate printing on the innerframe if desired. Still another example of desirable improvements would be the inclusion of structures which could be made to project into the interior of the finished carton to take up some of the space in the carton in the event that it was to be used for fewer than the maximum number of packs or for packs of smaller than the maximum size.

In view of the foregoing, it is an object of this invention to provide improved cigarette cartons which generally resemble and function like hinge lid cigarette boxes.

It is another object of this invention to provide cigarette cartons of the above-mentioned type which can be made with less cardboard stock.

It is still another object of this invention to provide cigarette cartons of the above-mentioned type which are better suited to being set up empty, followed by filling with cigarette packs either manually or by machine.

It is yet another object of the invention to provide cigarette cartons of the above-mentioned type in which the outer surface of the innerframe is the same blank surface as the outer surface of the carton.

It is still another object of the invention to provide cigarette cartons of the above-mentioned type including panels which can be made to project into the interior of the finished carton to take up space in the carton if desired.

SUMMARY OF THE INVENTION

These and other objects of the invention are accomplished in accordance with the principles of the invention by providing a cigarette carton blank which has the following panels side by side in order: a first side outer panel, a front outer panel, a second side outer panel, a rear outer panel, a first side innerframe panel, a front innerframe panel, and a second side innerframe panel. The first side outer panel, the front outer panel, and the second side outer panel are cut most but not all of the way across along the line which will form the boundary between the lower main portion and upper lid portion of the finished carton. The rear outer panel is scored from side to side along the line which will form the hinge between the lower main portion and the upper lid portion of the finished carton. The lower portion of one or more of the innerframe panels may include subpanels which can be made to project out into the interior of the finished carton if desired to take up some of the space in the carton. Although other types and locations of the flap and cover panels which will now be described are possible, in the preferred embodiments each of the outer side panels has a bottom flap panel projecting down from the side panel and a top flap panel projecting up from the side panel. The front outer panel has a bottom cover panel with a bottom tuck flap panel extending down from the front outer panel, and a similar top cover panel with a top tuck flap panel extending up from the front outer panel.

Although the carton can be made from the above-described blank by any of several techniques, in the finished carton each of the side by side adjacent panels forms a 90° angle with each adjacent side by side panel. Accordingly, the first side innerframe panel is inside the first side outer panel, the innerframe front panel is inside the front outer panel, and the second side innerframe panel is inside the second side outer panel. Preferably, at least the side innerframe panels are glued to the adjacent side outer panels. The bottom of the carton is closed by folding in the bottom flap panels and then folding over the bottom cover panel and tucking the bottom cover tuck flap panel inside the rear outer panel. Portions of the bottom cover tuck flap panel preferably interlock with the bottom flap panels to help keep the bottom cover panel closed. The top is closed in a similar fashion. If the innerframe is provided with subpanels for taking up space in the carton, these can be folded out at any appropriate time.

The carton can be filled with cigarette packs at any appropriate time. For example, the carton can be made up around the cigarette packs, or the carton can be made up empty and filled with cigarette packs either through the top or bottom. Filling can be manual if desired. The consumer opens the box by breaking the small connections left uncut across the boundary between the bottom main portion and the upper lid portion.

Further features of the invention, its nature and various advantages will be more apparent from the accompanying drawings and the following detailed description of the preferred embodiments.

Figure 1:
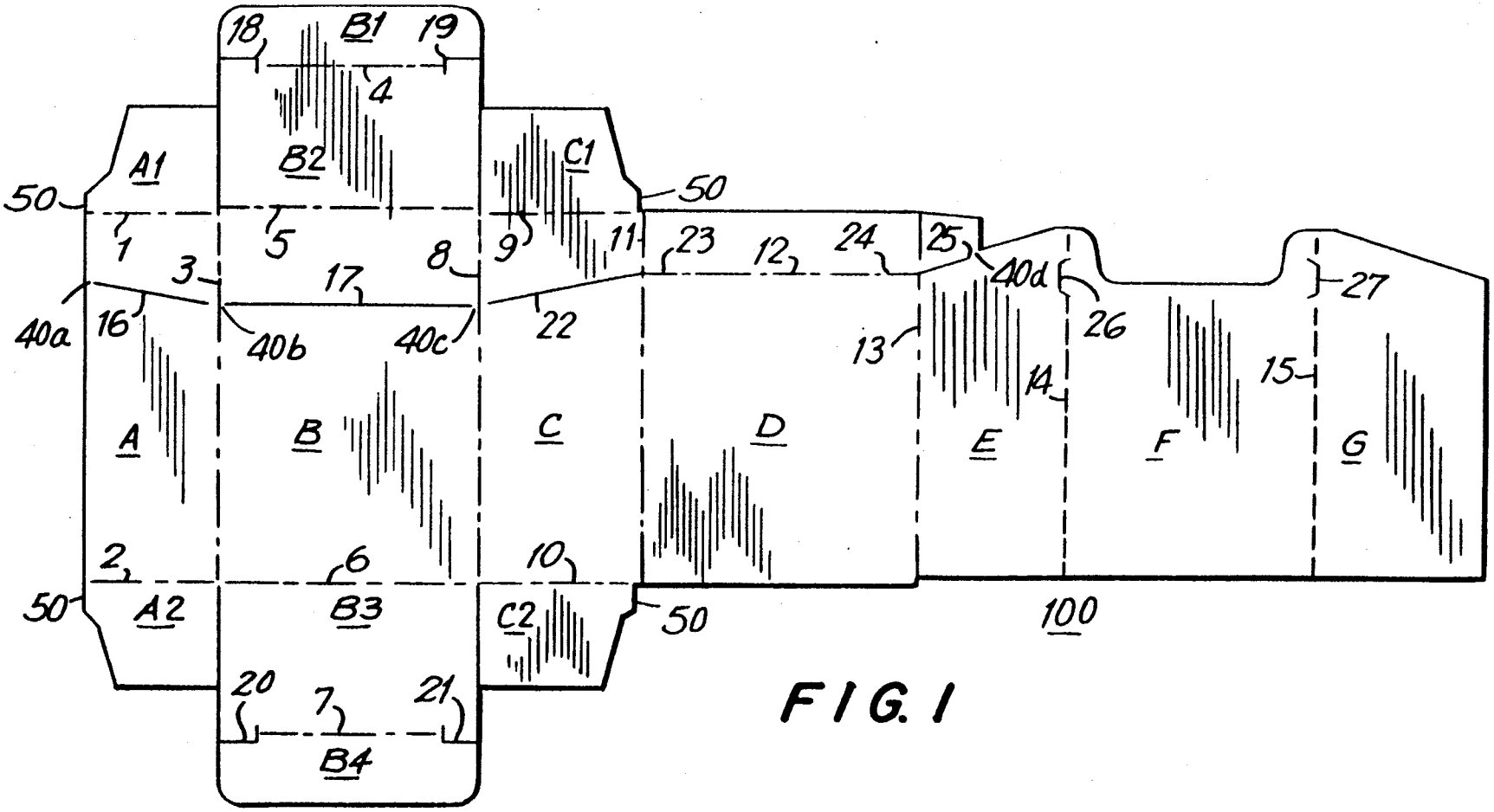
FIG. 1 is a plan view of an illustrative carton blank constructed in accordance with the principles of this invention.

FIGS. *2a*, *2b*, and *2c* (referred to collectively as FIG. 2) are a flow chart of a preferred method of folding blanks of the type shown in FIG. 1 into a carton in accordance with the principles of this invention.

Figure 3:
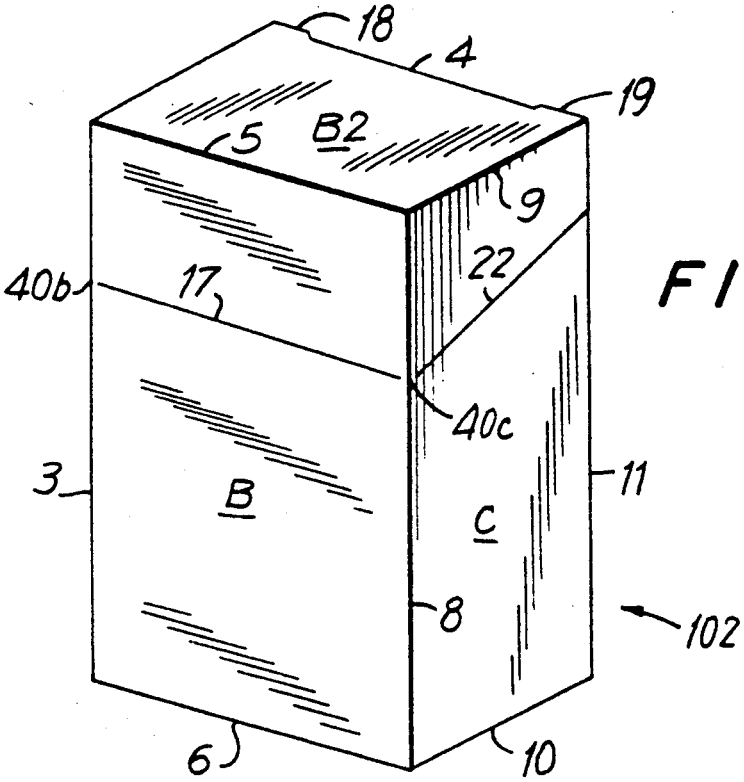

FIG. 3 is an isometric view of a carton made from the blank shown in FIG. 1 before the carton has been opened for the first time by the consumer.

Figure 4:
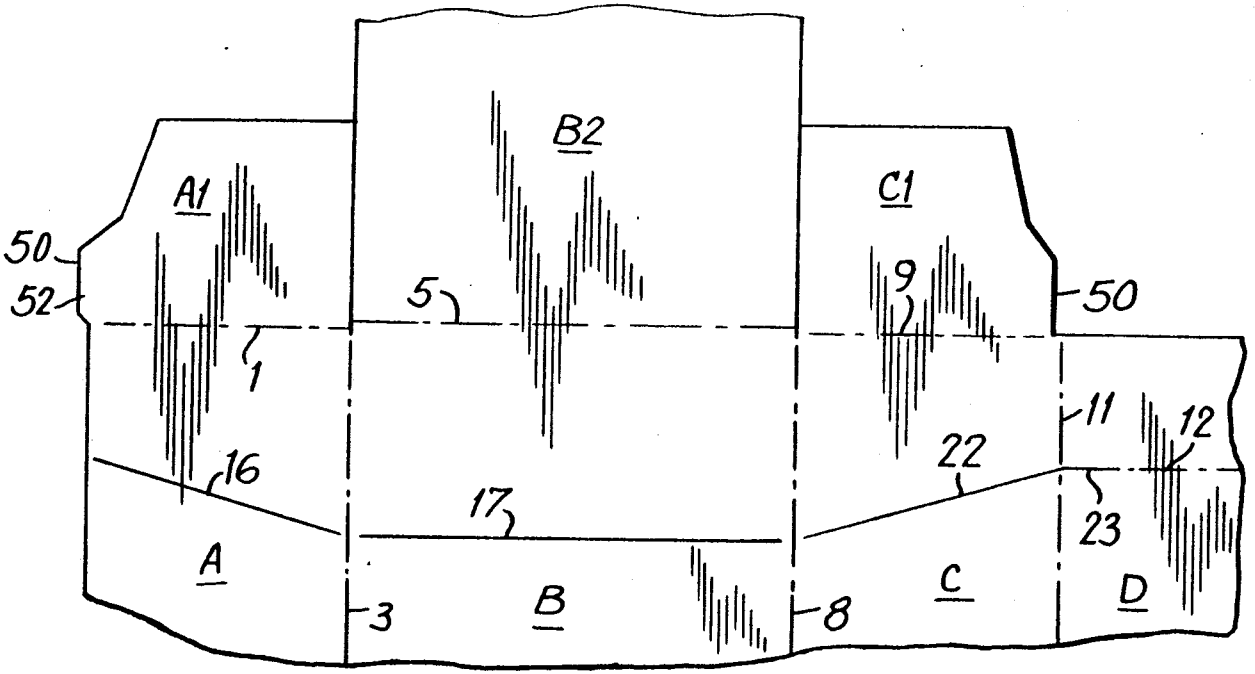

FIG. 4 is a view similar to a portion of FIG. 1 showing possible modifications of the blank in accordance with the principles of this invention.

Figure 5:
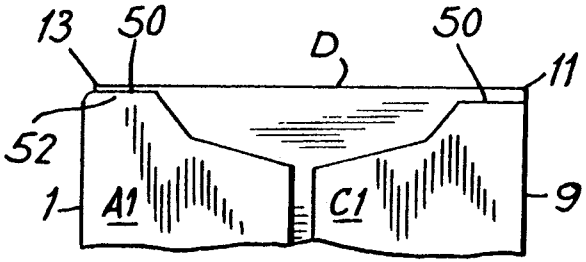

FIG. 5 is a simplified, partial, top plan view of a carton partly made up from the modified blank shown in FIG. 4.

FIG. *6a* is an isometric view of the carton shown in FIGS. 3 or 5 with the hinge lid pivoted open.

FIG. *6b* is an isometric view of the carton shown in FIG. *6a* with the hinge lid pivoted further open.

Figure 7:
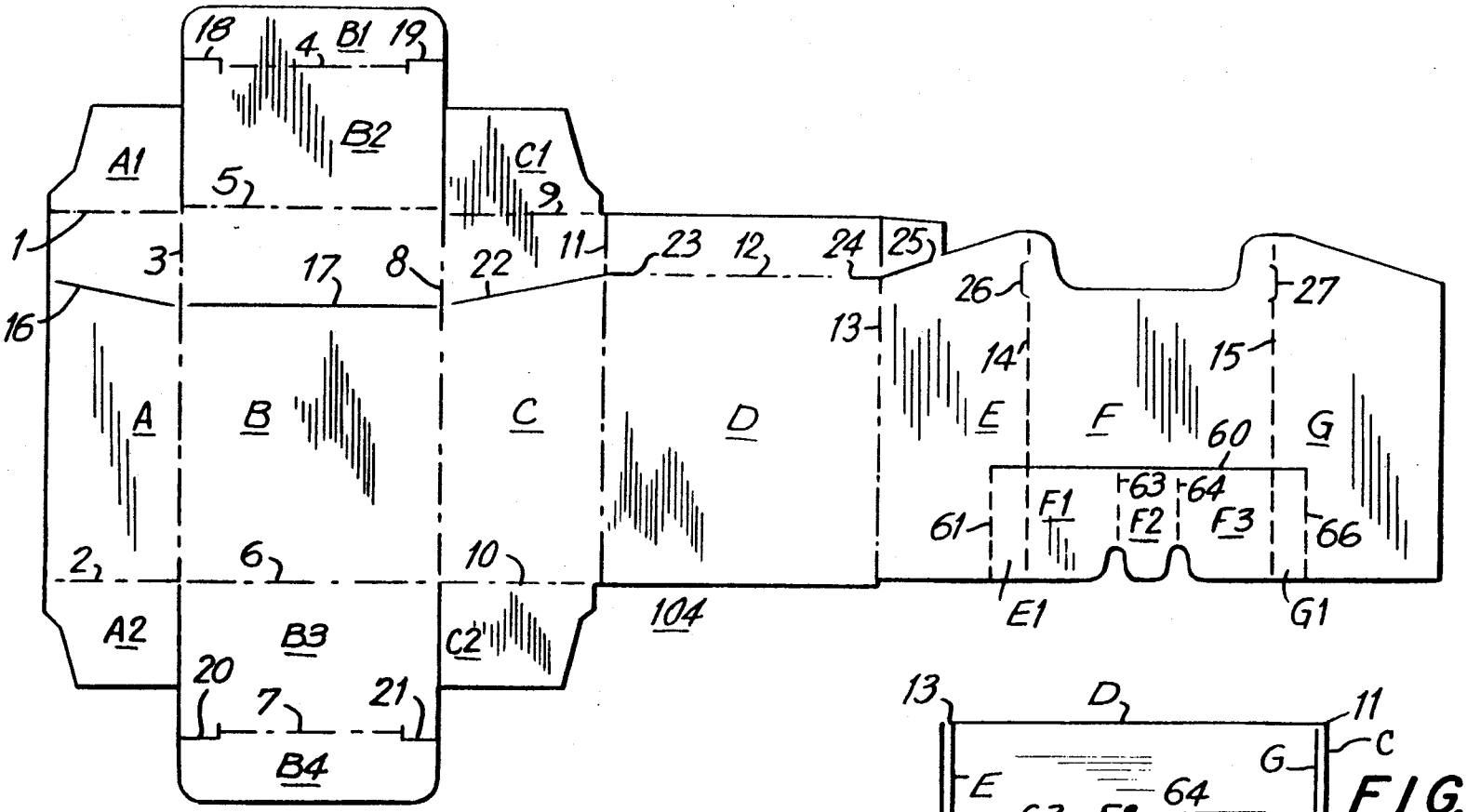

FIG. 7 is a view similar to FIG. 1 showing an alternative carton blank constructed in accordance with the principles of this invention.

Figure 8:
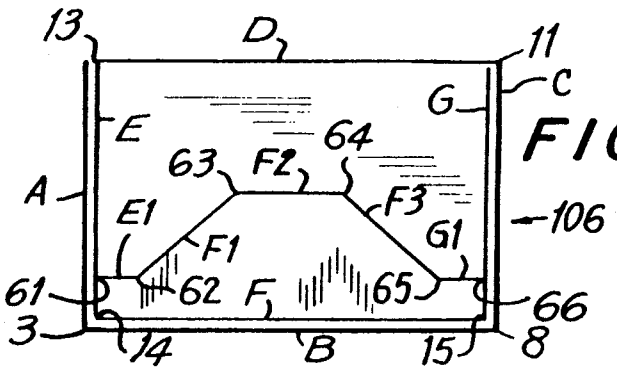

FIG. 8 is a greatly simplified view looking down into the bottom of a carton made from the blank shown in FIG. 7. None of the bottom flap or cover panels are shown in FIG. 8, and panels which are in fact face to face are spaced apart in FIG. 8 for greater clarity.

DETAILED DESCRIPTION OF THE PREFERRED EMBODIMENTS

An illustrative carton blank !00 constructed in accordance with this invention is shown in plan view in FIG. 1. The surface of the blank shown in FIG. 1 includes what will be the outer surface of the finished carton. Blank 100 includes the following panels side by side in order: left side outer panel A, front outer panel B, right side outer panel C, rear outer panel D, left side innerframe panel E, front innerframe panel F, and right side innerframe panel G. The boundaries between these panels are as follows: between panels A and B, score line 3; between panels B and C, score line 8; between panels C and D, score line 11; between panels D and E, score line 13; between panels E and F, perforation line 14 and a small retention cut 26; and between panels F and G, perforation line 15 and a small retention cut 27. Panels A, B, and C are subdivided by cuts 16, 17, and 22, respectively. Small connections are left across these cuts so that panels A–C do not actually subdivide until the consumer intentionally breaks these connections in order to open the carton as described in more detail below. In particular, one such small connection 40*a* is preferably left at the extreme left-hand edge of the blank, and other such connections 40*b* and 40*c* are preferably left adjacent score lines 3 and 8, respectively. Still other such connections may be left elsewhere along lines 16, 17, 22, and 23 as required and/or desired. Panel D is subdivided by short cuts 23 and 24 and longer score line 13. Cuts 23 and 24 may be eliminated if desired and score line 12 extended in their stead. Panel E is subdivided by cut 25. One or more small connections are preferably left across cut 25 for the same reason described above in relation to cuts 16, 17, and 22. In particular, one such small connection 40*d* is preferably left at the extreme right-hand end of cut 25. It will be noted that elements 16, 17, 22, 23, 12, 24, and 25 form one substantially continuous (although not straight) line.

Bottom flap panels A2 and C2 extend down from side panels A and C, respectively, and top flap panels A1 and C1 similarly extend up from side panels A and C, respectively. Bottom cover panel B3 and bottom cover tuck flap panel B4 extend down from front panel B, and top cover panel B2 and top cover tuck flap panel B1 similarly extend up from front panel B. The boundaries between these panels are as follows: between panels A and A1, score line 1; between panels A and A2, score line 2; between panels B and B2, score line 5; between panels B2 and B1, short end cuts 18 and 19 separated by longer central score line 4; between panels B and B3, score line 6; between panels B3 and B4, short end cuts 20 and 21 separated by longer central score line 7; between panels C and C1, score line 9; and between panels C and C2, score line 10. Panels Al, B2, C1, A2, B3, and C2 are not directly connected to one another. Score lines 1 and 2 and score lines 9 and 10 are slightly closer together than score lines 5 and 6 because flaps A1, C1, A2, and C2 must be folded inside the covers B2 and B3 in the finished carton. Cuts 18 and 19 are slightly farther than score line 4 from score line 5 so that when panel B1 is tucked inside the carton, the edges of panel B1 adjacent those cuts tend latch under edges 50 of panels A1 and C1, thereby helping to hold the top cover closed. Cuts 20 and 21 are similarly farther than score line 7 from score line 6 so that when panel B4 is tucked inside the carton, the edges of panel B3 adjacent those cuts tend to latch under edges 50 of panels A2 and C2, thereby helping to hold the bottom cover closed.

The top edge of panel F includes a recess so that the visible top of the innerframe in the finished carton generally resembles the visible portion of the innerframe in a conventional hinge lid cigarette box. The bottom edges of panels E–G are slightly recessed because these panels will be inside other panels in the finished carton and should not interfere with the clean folding of panels A2, B3, and C2.

Figure 2A:
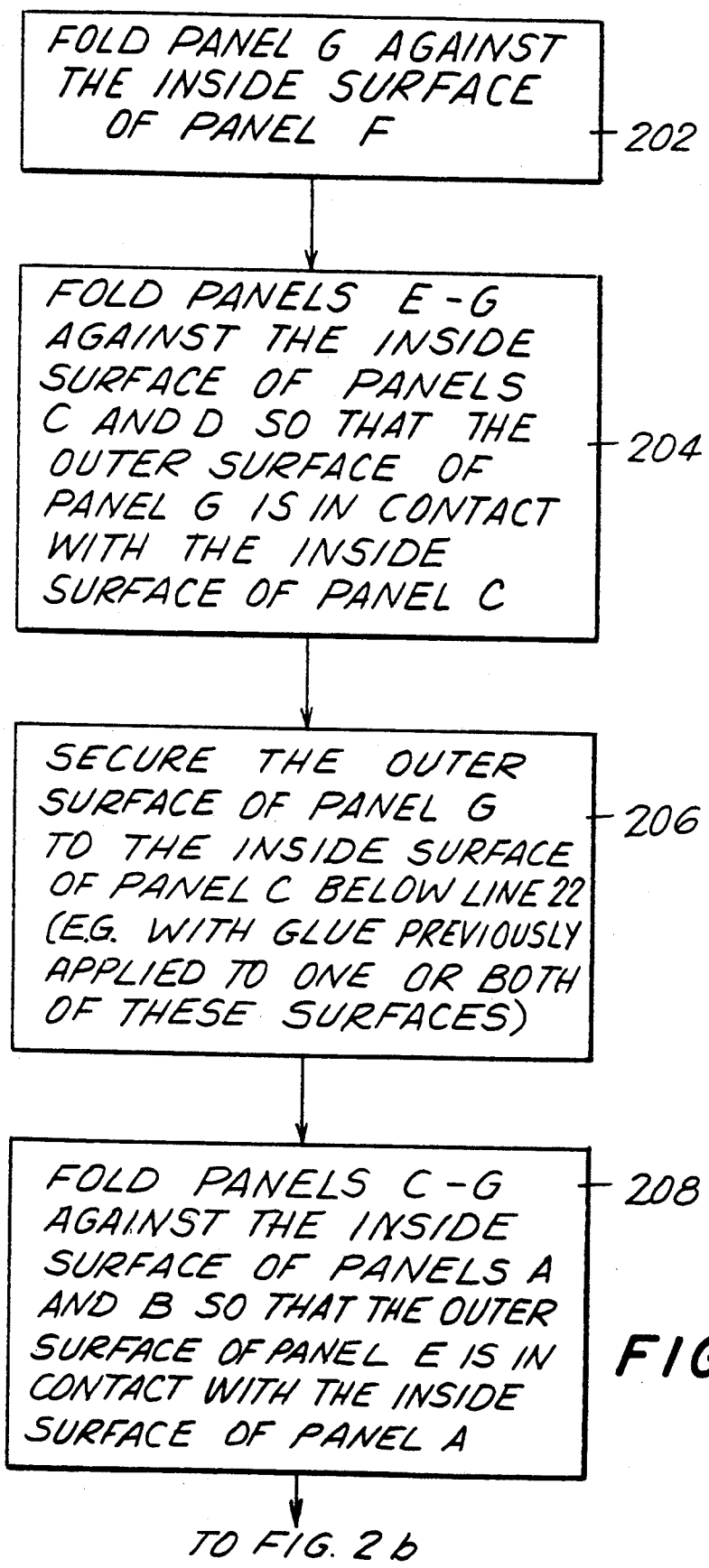
Figure 2B:
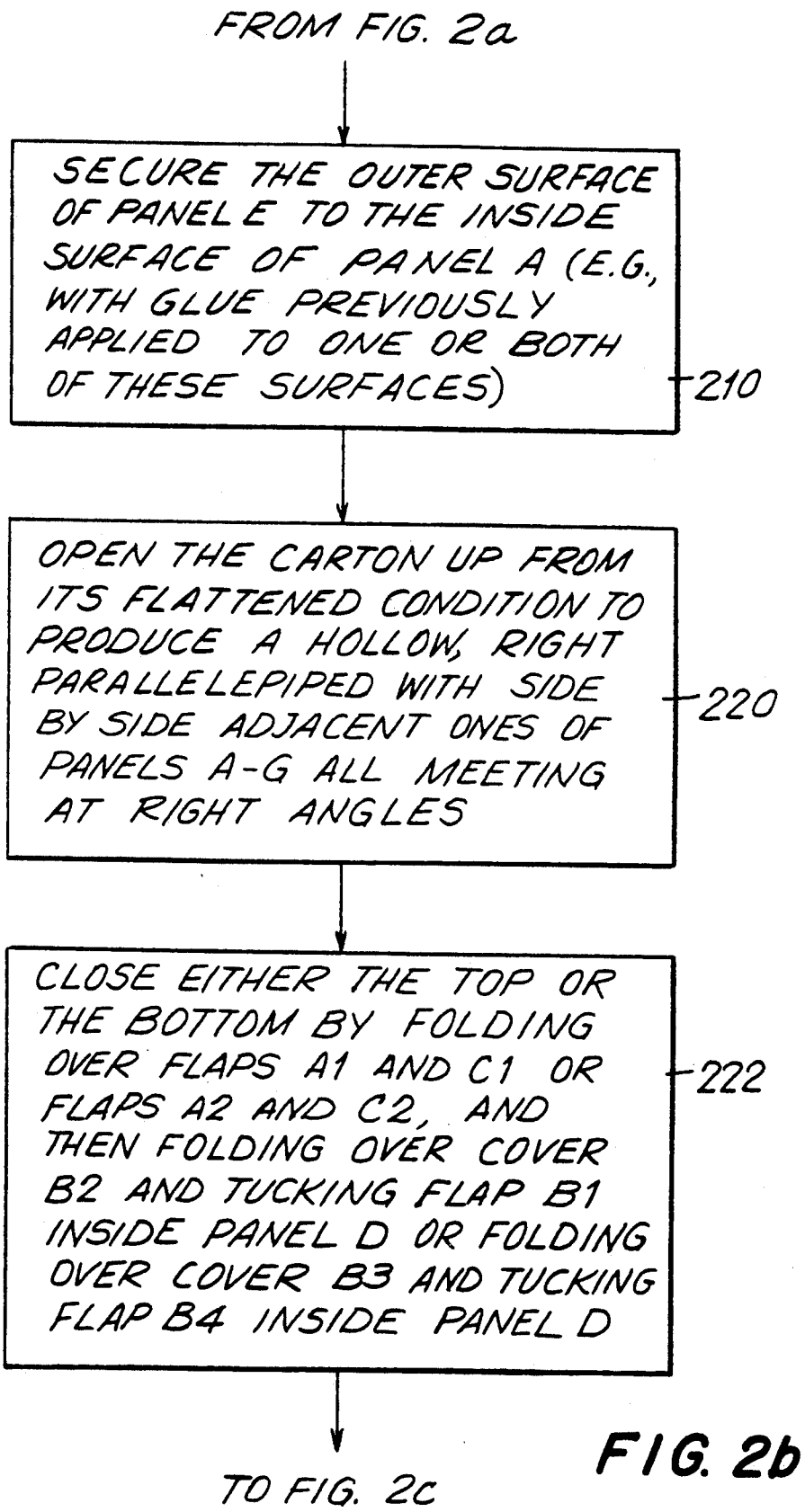
Figure 2C:
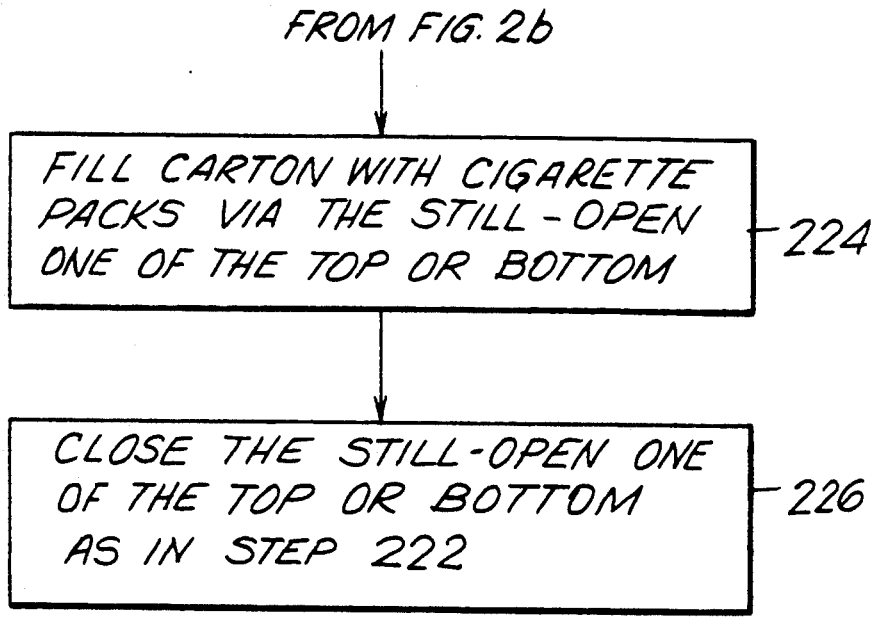

Although the blank of FIG. 1 can be made up into a carton in other ways, a particularly preferred method is shown in FIG. 2. In step 202 panel G is folded (along perforation line 15) against the inside surface of panel F. (As was mentioned above, the surface of the blank shown in FIG. 1 is the outer surface. The surface of the blank which is not visible in FIG. 1 is the inside surface.) In step 204 panels E–G are folded (along score line 13) against the inside surface of panels C and D. This places the outer surface of panel G in contact and left-right registration with panel C. In step 206 the contacting surfaces of panels C and G are secured together (e.g., by glue which has been previously applied to one or both of these surfaces). This glue should not extend above line 22. In step 208 panels C–G are folded (along score line 8) against the inside surface of panels A and B. This places the outer surface of panel E in contact and left-right registration with the inside surface of panel A. In step 210 the contacting surfaces of panels A and E are secured together (e.g., by glue which has been previously applied to one or both of these surfaces). This securing should be such that no part of panel E below cut 25 is secured to any part of panel A above cut 16. However, the portion of panel E above cut 25 should be secured to the portion of panel A above cut 16. This completes a first phase of the assembly of the carton. At the end of this phase, the carton is substantially flat, which is convenient for storage and/or shipment.

The second phase of carton set up begins with step 220. In this step the carton is opened up from its flattened condition to a hollow, right parallel-piped. Because panels E and G are respectively secured to panels A and C, the innerframe automatically "pops up" into the correct location in the carton when it is opened up in step 220 (i.e., panels E–G remain in place in contact with panels A–C, respectively). This facilitates loading and completion of the carton because the innerframe does not have to be separately handled at this point to ensure that it is in the proper position. In step 222 either the top or bottom of the carton is closed. This is accomplished by folding either flaps A1 and C1 or flaps A2 and C2 inwardly 90° relative to panels A and C, and folding panel B2 or B3 over those flaps. Tuck flap B1 or B4 is then tucked inside rear wall D of the carton. The edges of the tuck flap beyond cuts 18 and 19 or 20 and 21 engage under flaps A1 and C1 or A2 and C2 adjacent their edges 50 in order to interlock with those flaps, thereby holding cover panel B2 or B3 securely closed. In step 224 the carton is filled with cigarette packs via the top or bottom, whichever was not closed in step 222. In the depicted preferred embodiment, the carton is sized to hold five cigarette packs (20 cigarettes to a pack) stacked back to front on top of one another from the bottom of the carton to the top. In step 226 the carton is finished by closing the top or bottom through which the carton was filled in step 224. Step 226 is therefore substantially the same as step 222, but is performed on the other end of the carton. FIG. 3 shows the finished carton 102 before it has been opened for the first time by the consumer.

Note that steps 222 through 226 can be performed either manually or by machine, although the carton of this invention is particularly well suited to performance of these steps by hand. The fact that the innerframe automatically pops up into the correct position in step 220 as described above facilitates manual handling of the carton at this point. Similarly, the use of top and bottom covers with tuck flaps B1 and B4 facilitates manual closing, loading, and finishing of the carton. No glue is required to close and finish the carton.

If desired, finishing (and especially manual finishing) of carton 102 can be further facilitated in accordance with the principles of this invention by modifying some or all of flaps A1, A2, C1, and C2 as shown, for example, in FIGS. 4 and 5. As shown in FIG. 4 flap A1 has an extension 52 which extends to the left from the left-hand edge of panel A. This shifts the edge 50 of panel A1 slightly to the left as viewed in FIG. 4. The corresponding edge 50 of panel C1 is also shifted slightly to the left by recessing panel C1 away from the axis of score line 11 in the vicinity of edge 50. Accordingly, when the carton is made up and flaps A1 and C1 are folded in as shown in FIG. 5, edge 50 of flap A1 tends to be substantially closer to rear panel D than edge 50 of flap C2 is to rear panel D. The relatively wide spacing between edge 50 of flap C1 and rear wall D facilitates insertion of tuck flap B1 into the carton inside rear wall D. The smaller spacing between edge 50 of flap A1 and rear wall D ensures that tuck flap B1 will be securely latched under that portion of flap A1. The extension of flap A1 in this manner also helps to ensure that such latching will take place despite variation in where the extreme left edge of panel A occurs relative to score line 13 when the carton is made up. Of course, the spacing between edge 50 of flap C1 and rear wall D is preferably not so great that tuck flap B1 does not also tend to latch under that portion of flap C1.

Although only flaps A1 and C1 are shown in FIGS. 4 and 5, it will be understood that flaps A2 and C2 can be modified in the same way if desired. Similarly, although flap A1 is shown with extension 52 while flap C1 is recessed, it will be understood that these features could be reversed, with flap C1 extended to the right adjacent its edge 50 while flap A1 is recessed to the right adjacent its edge 50.

Although FIG. 2 shows a particularly preferred method of folding the blank of FIG. 1 to form a carton, it will be understood that the carton can be made in other ways if desired. For example, the blank can be folded around a stack of cigarette packs so that it is already filled when made up. Similarly, the top and bottom closure panels can be different from those shown in the drawings. For example, simple panels which are folded over and glued together can be substituted if it is not desired to use the tuck flap and latching principle.

Figure 6B:
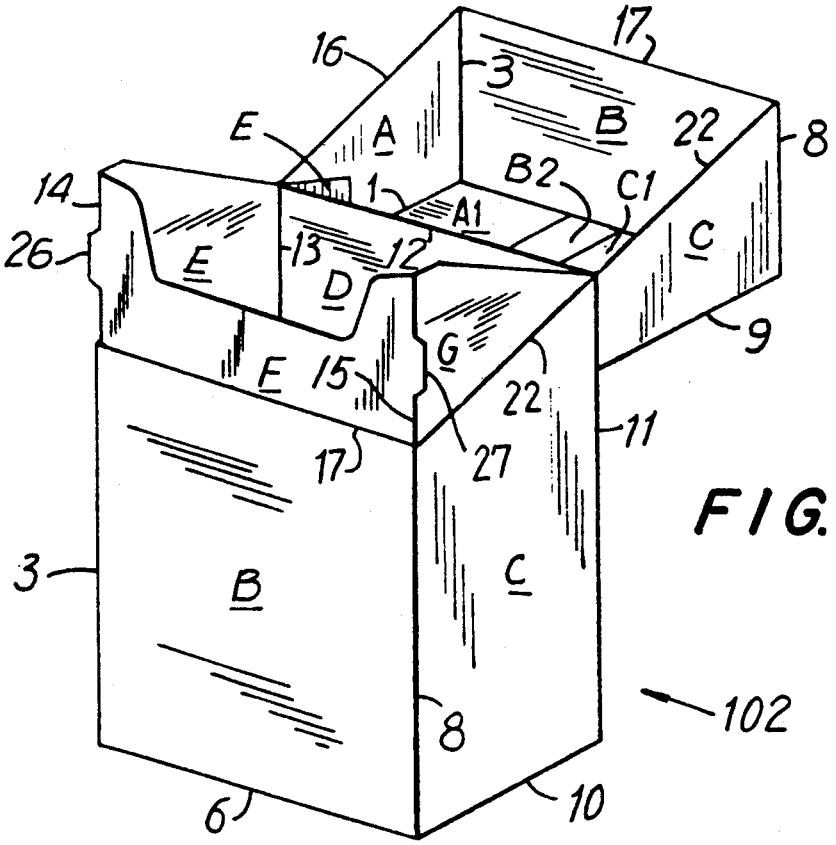
Figure 6A:
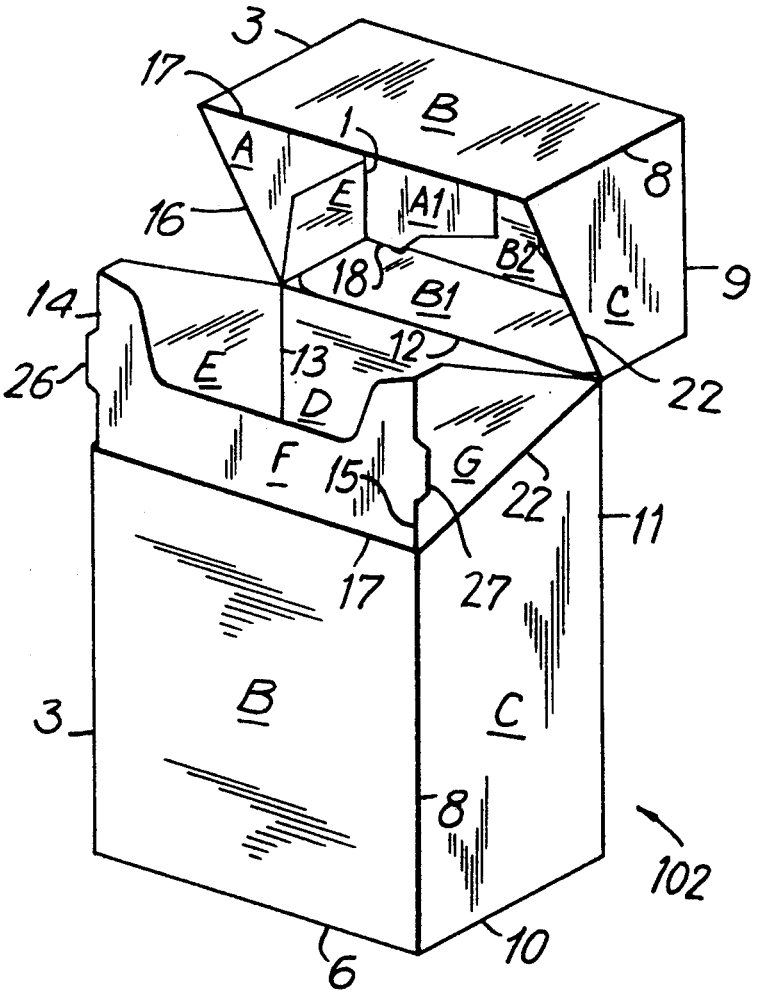

When the consumer wants to open carton 102 for the first time, he or she breaks the small connections 40 across lines 16, 17, and 22. The lid portion above these lines can then be pivoted up and to the rear along score line 12 as shown in FIGS. 6*a* and 6*b* in order to remove a cigarette pack from the carton. The portions of innerframe panels E–G which project above outer member panels A–C interfere somewhat with this pivoting of the lid, thereby helping to keep the lid closed when it is subsequently pivoted back to the closed position. The slightly outwardly projecting edges adjacent cuts 26 and 27 also help to keep the lid completely and neatly closed. These are functions similar to those performed by innerframes in known hinge lid cigarette packs. The recess in the top of panel F also helps make the innerframe in carton 102 resemble the innerframe in conventional hinge lid cigarette packs.

FIGS. 7 and 8 show an alternative embodiment in which innerframe panels E–G include lower subpanels E1, F1, F2, F3, and G1 which can be folded out into the interior of the carton to take up some of the space in the carton in the event that all of that space is not needed. (The features shown in FIGS. 4 and 5 can, of course, be included in this alternative embodiment if desired.) Blank 104 (FIG. 7) can be similar to blank 100 (FIG. 1) except for the provision of these innerframe subpanels as will now be described in detail. Subpanels E1, F1, F2, F3, and G1 are separated from the portions of innerframe panels E–G above them by cut 60. Subpanel E1 is connected to panel E on the left by perforation line 61. Perforation line 14 connects subpanel E1 to subpanel F1. Perforation line 63 connects subpanel F1 to subpanel F2. Perforation line 64 connects subpanel F2 to subpanel F3. Perforation line 15 connects subpanel F3 to subpanel G1. And subpanel G1 is connected to panel G on the right by perforation line 66. The bottom of blank 104 is recessed near the lower ends of perforation lines 63 and 64.

Blank 104 can be made up into a carton 106 (FIG. 8) in substantially the same way that blank 100 is made up into carton 102. At any convenient time, however, subpanels E1 and G1 are folded in along perforation lines 61 and 66 relative to panels E and G. This allows subpanels F1–F3 to move well into the interior of the lower portion of the carton as shown in FIG. 8. Perforation lines 63 and 64 allow these subpanels to fold relative to one another as necessary to traverse the bottom of the carton. When deployed into the interior of the carton in this way, subpanels E1, F1, F2, F3, and G1 fill up the space in the carton below cut 60 and support cigarette packs above the level of that cut, thereby allowing the carton to be filled with fewer cigarette packs than would otherwise be required to fill the carton if these subpanels were not so deployed.

It will be understood that the foregoing is merely illustrative of the principles of this invention, and that various modifications can be made by those skilled in the art without departing from the scope and spirit of the invention. For example, the size of the carton can be modified so that it can hold any number of cigarette packs of any size. As another example, the amount of space taken up by subpanels E1, F1, F2, F3, and G1 can be altered by changing the vertical location of cut 60. As still another example of possible modifications, the innerframe panels could extend to the left (rather than from the right) of the outer member panels as viewed in FIG. 1. (The left-right order of the outer member panels would then also have to be reversed.) The top and bottom closure panels (e.g., A1, B2, and C1) do not have to be connected to panels A–C as shown in the drawings, but could be connected to others of the side by side adjacent panels if desired.

What is claimed is:

1. A blank for use in making a hinge lid cigarette carton including a lower main body portion, an upper lid portion pivotally connected to the lower main body portion, and an innerframe disposed inside said lower main body portion so that it projects above said lower main body portion into the interior of said upper lid portion, said blank comprising:

first, second, third, fourth, fifth, sixth, and seventh panels connected to one another side by side in order, said first through fourth panels respectively comprising four vertical outer surfaces of said carton, and said fifth through seventh panels comprising said innerframe such that said fifth through seventh panels are respectively inside and adjacent to said first through third panels in said carton;

a top closure panel extending from one of said second and fourth panels and folded substantially perpendicular to said one of said second and fourth panels to close the top of said hinge lid;

a tuck flap portion extending from said top closure panel and folded substantially perpendicular to said top closure panel and inside said carton to close the top of said hinge lid, said tuck flap portion having first and second side edges;

a first flap extending from one of said first and third panels; and a second flap extending from the other of said first and third panels;

wherein one of said first and second side edges of said tuck flap portion interlocks with said first flap to securely close the top of said hinge lid, and the other of said first and second side edges of said tuck flap portion interlocks to a lesser extent with said second flap to facilitate insertion of said tuck flap portion inside said carton, so that closing, loading, and finishing of said blank is facilitated.

2. The blank defined in claim 1 further comprising:

a bottom closure panel connected to a selected one of said first through seventh panels and extending from said predetermined one of said first through seventh panels in a direction perpendicular to the side by side connection of said first through seventh panels and opposite the direction in which said top closure panel extends for closing the bottom of said carton.

3. The blank defined in claim 1 wherein said first through third panels are cut through at least most of the way across from side to side to provide the separation between said lower main body portion and said upper lid portion along which said carton can be opened by pivoting said upper lid portion relative to said lower main body portion.

4. The blank defined in claim 3 wherein at least one of said first through third panels is not cut all the way across and at least one relatively small connection transverse to said cut is left in said one of said first through third panels.

5. The blank defined in claim 4 wherein said relatively small connection is adapted to be broken by an end user of said carton.

6. The blank defined in claim 5 wherein said relatively small connection is adjacent a vertical corner in said carton.

7. The blank defined in claim 1 further comprising a score line between said top closure panel and said tuck flap portion, and wherein said top closure panel is cut for a short distance parallel to said score line but just beyond said score line in the direction away from said one of said second and fourth panels, said short distance starting at the edge of said top closure panel which is adjacent to said first flap in said carton so that the edge of said tuck flap portion on the side of said cut remote from said one of said second and fourth panels engages inside said first flap when said tuck flap portion is folded inside said carton.

8. The blank defined in claim 7 wherein said first flap includes an extension adjacent to said one of said first and third panels, said extension extending in a direction parallel to the side by side connection of said first through seventh panels and away from said one of said second and fourth panels in said carton so that said edge of said tuck flap portion on the side of said cut remote from said one of said second and fourth panels engages inside said extension when said tuck flap portion is folded inside said carton.

9. The blank defined in claim 8 wherein said top closure panel has a second cut extending for a short distance parallel to said score line but just beyond said score line in the direction away from said one of said second and fourth panels, said second cut starting at the edge of said top closure panel which is adjacent to said second flap in said carton so that the edge of said tuck flap portion on the side of said second cut remote from said one of said second and fourth panels engages inside said second flap when said tuck flap portion is folded inside said carton.

10. The blank defined in claim 9 wherein said extension extends further toward said edge of said tuck flap portion on the side of said cut than said second flap extends toward said edge of said tuck flap portion on the side of said second cut so that said tuck flap portion is more easily folded into said carton adjacent said second cut but more securely interlocked adjacent said extension.

11. The blank defined in claim 1 wherein at least one of said fifth through seventh panels includes a subpanel foldable into the interior of said carton to occupy some of the space in said carton.

12. The blank defined in claim 11 wherein said fifth through seventh panels respectively include first through third subpanels, said first through third subpanels being connected to one another side by side in order and extending parallel to the side by side connection of said first through seventh panels, said first through third subpanels being partly separated from said fifth through seventh panels by a cut parallel to the side by side connection of said first through seventh panels so that said first through third subpanels can be folded into the interior of said carton to occupy some of the space in said carton.

13. The blank defined in claim 1 wherein said carton has a vertical front wall, a vertical rear wall parallel to and spaced from said front wall, a vertical left side wall extending between said front and rear walls, and a vertical right side wall extending between said front and rear walls, wherein said upper lid portion is pivotally connected to the lower main body portion at said rear wall, and wherein said fourth panel forms said rear wall.

14. The blank defined in claim 13 wherein said second panel forms said front wall.

15. The blank defined in claim 14 wherein said first through third panels are cut through at least most of the way across from side to side to provide the separation between said lower main body portion and said upper lid portion along which said carton can be opened by pivoting said upper lid portion relative to said lower main body portion.

16. The blank defined in claim 15 wherein said cut does not extend all the way across said first panel and a relatively small uncut region is left in said first panel adjacent the edge remote from said second panel.

17. The blank defined in claim 15 wherein said cut is interrupted adjacent the connection between said first and second panels and adjacent the connection between said second and third panels.

18. The blank defined in claim 17 wherein the interruptions in said cut are adapted to be broken by the end user of the carton when the end user first pivots the upper lid portion open.

19. The blank defined in claim 14 comprising:

wherein said top closure panel is connected to said second panel and extends from said second panel in a direction perpendicular to the side by side connection of said first through seventh panels.

20. The blank defined claim 19 further comprising:

a bottom closure panel connected to said second panel and extending from said second panel in a direction opposite to the direction in which said top closure panel extends from said second panel for closing the bottom of said carton.

21. The blank defined in claim 19 comprising a score line between said top closure panel and said tuck flap portion, and wherein said top closure panel has first and second relatively short cuts parallel to said score line but just beyond said score line in the direction away from said second panel, said first and second cuts starting at respective opposite edges of said top closure panel.

22. The blank defined in claim 21 wherein the edges of said tuck flap portion on the sides of said first and second cuts remote from said second panel respectively engage inside said first and second flaps when said tuck flap portion is folded inside said carton.

23. The blank defined in claim 21 wherein each of said first and second flaps has an edge adjacent to said fourth panel when said first and second flaps are folded over said top of said carton, and wherein said edge of said first flap is closer to said fourth panel than said edge of said second flap to enhance engagement of said tuck flap portion inside said first flap, while the greater space between said edge of said second flap and said fourth panel facilitates insertion of said tuck flap portion into said carton.

24. A hinge lid cigarette carton including a lower main body portion, an upper lid portion pivotally connected to the lower main body portion, and an innerframe disposed inside said lower main body portion so that it projects above said lower main body portion into the interior of said upper lid portion, said carton being made from a blank which includes first, second, third, fourth, fifth, sixth, and seventh panels connected to one another side by side in order, said blank being folded so that said fifth through seventh panels are respectively inside and adjacent to said first through third panels to form said innerframe while said first through fourth panels form said lower main body portion and said upper lid portion, at least two of said fifth through seventh panels being secured to the insides of the adjacent ones of said first through third panels so that said carton opens from a flattened condition, in which all of said first through seventh panels are parallel to one another, to a rectangular condition, in which adjacent ones of said first through fourth panels meet one another at right angles, with the fifth through seventh panels remaining respectively adjacent to said first through third panels; wherein said upper lid portion comprises a first dust flap, a second dust flap, and a top closure having a tuck flap portion, said tuck flap portion interlocking with said first dust flap to securely close the upper portion of said upper lid portion and interlocking with said second dust flap to a lesser extent to allow for said tuck flap portion to be easily folded inside said carton to close the upper portion of said upper lid portion, so that said upper lid portion can be folded into a closed position when said carton is opened from said flattened condition into said rectangular condition.

25. The carton defined in claim 24 wherein said fifth panel is secured to the inside of said first panel and said seventh panel is secured to the inside of said third panel.

26. The carton defined in claim 25 wherein said fifth and seventh panels are respectively secured to the inside of said first and third panels by glue.

27. A blank for use in making a hinge lid cigarette carton including a lower main body portion, an upper lid portion pivotally connected to the lower main body portion, and an innerframe disposed inside said lower main body portion so that it projects above said lower main body portion into the interior of said upper lid portion, said blank comprising:

first, second third, fourth, fifth, sixth, and seventh panels connected to one another side by side in order, said first through fourth panels respectively comprising four vertical outer surfaces of said carton, and said fifth through seventh panels comprising said innerframe such that said fifth through seventh panels are respectively inside and adjacent to said first through third panels in said carton; wherein at least one of said fifth through seventh panels includes a subpanel foldable into the interior of said carton to occupy some of the space in said carton.

28. The blank defined in claim 27 wherein said fifth through seventh panels respectively include first through third subpanels, said first through third subpanels being connected to one another side by side in order and extending parallel to the side by side connection of said first through seventh panels, said first through third subpanels being partly separated from said fifth through seventh panels by a cut parallel to the side by side connection of said first through seventh panels so that said first through third subpanels can be folded into the interior of said carton to occupy some of the space in said carton.

* * * * *